US008237737B2

(12) United States Patent
Lu

(10) Patent No.: US 8,237,737 B2
(45) Date of Patent: Aug. 7, 2012

(54) METHOD FOR CLEARING BLUR IMAGES OF A MONITOR

(75) Inventor: Ming-Hsun Lu, Taipei County (TW)

(73) Assignee: Princeton Technology Corporation, Taipei County (TW)

( * ) Notice: Subject to any disclaimer, the term of this patent is extended or adjusted under 35 U.S.C. 154(b) by 625 days.

(21) Appl. No.: 12/357,877

(22) Filed: Jan. 22, 2009

(65) Prior Publication Data

US 2010/0097394 A1 Apr. 22, 2010

(30) Foreign Application Priority Data

Oct. 16, 2008 (TW) ..... 97139714 A

(51) Int. Cl.
*G09G 5/02* (2006.01)

(52) U.S. Cl. ..... 345/604; 345/87

(58) Field of Classification Search ..... 345/604
See application file for complete search history.

(56) References Cited

U.S. PATENT DOCUMENTS

2005/0270303 A1* 12/2005 Li ..... 345/603
2007/0188514 A1* 8/2007 Li ..... 345/604
2008/0279470 A1* 11/2008 Warmuth et al. ..... 382/255

* cited by examiner

*Primary Examiner* — Javid A Amini
*Assistant Examiner* — Peter Hoang
(74) *Attorney, Agent, or Firm* — Muncy, Geissler, Olds & Lowe, PLLC

(57) ABSTRACT

A method for clearing blur images of a monitor is disclosed. An original image data is provided. The original image data is transformed from an RGB encoded format to a YUV encoded format. The transformation is compressed as the original image data with the YUV encoded format. The compressed original image data is written in a random access memory (RAM) using a predefined method. The compressed original image data is decompressed. The original image data is transformed from the YUV encoded format to the RGB encoded format. The original image data is outputted to a display device using a driving unit.

3 Claims, 1 Drawing Sheet

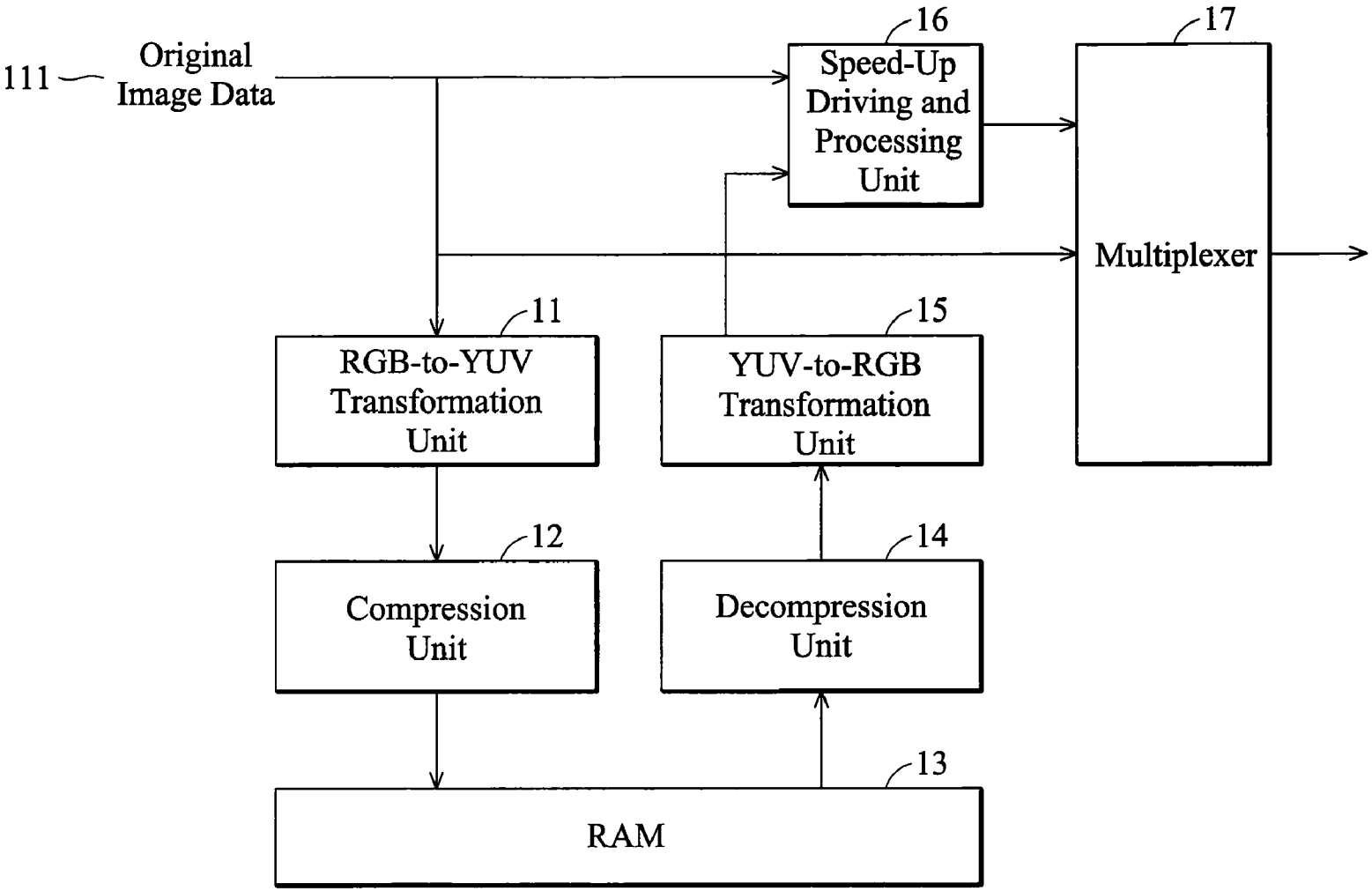
111
Original Image Data
16
Speed-Up Driving and Processing Unit
17
Multiplexer
11
RGB-to-YUV Transformation Unit
15
YUV-to-RGB Transformation Unit
12
Compression Unit
14
Decompression Unit
13
RAM

METHOD FOR CLEARING BLUR IMAGES OF A MONITOR

CROSS REFERENCE TO RELATED APPLICATIONS

This Application claims priority of Taiwan Patent Application No. 097139714, filed on Oct. 16, 2008, the entirety of which is incorporated by reference herein.

BACKGROUND OF THE INVENTION

1. Field of the Invention

The invention relates to a method for clearing blur images of a monitor, and more particularly to a method for clearing blur images of a monitor using a predefined Synchronous Dynamic Random Access Memory (SDRAM) storage method.

2. Description of the Related Art

With respect to traditional a liquid crystal display (LCD) monitor, since dynamic display technology cannot immediately update past frames with new frames, blur images may occur when dynamic images are displayed, resulting from insufficient reaction time of an image driving device. Generally, such problems can be solved by raising driving voltage so reaction time of displaying dynamic images can be effectively increased, wherein image frequency is reduced from 16.7 milliseconds (ms) to 5 ms or even 3 ms. However, blur images for dynamic images may still be viewed by human vision.

Some LCD driving chips provide "Black Insertion" to solve the described problem. That is to say, when a next frame is updated, driving of the LCD frame is stopped to show a black frame and a next frame is updated. The display of the black frame is for a short period of time, about 10 ms, to perform clearing of blur images. However, the "Black Insertion" results in reduction of image brightness and makes the frame darker.

To solve the problem, frequency multiplication and black insertion technology have been developed. Frequency multiplication doubles the frame rate of a frame from 60 Hz to 120 Hz while the frame is interpolated using a frame processor. Thus, a new frame is generated and inserted between two frames to reduce blur images. Frames with a frame rate of, for example, 120 f/s, must be displayed using a panel with a frequency of, for example, 8 ms, and a pure black frame is not inserted but a frame with a gray-scale average provided by the previous and following frames, maintain brightness and reduce blur images.

Because the frequency multiplication and black insertion technology requires rapid image processing, high voltage driving is required and requirement of image processing time is enhanced and is effective to LCD dynamic image display. Thus, a novel method to achieve frequency multiplication and black insertion is desirable.

BRIEF SUMMARY OF THE INVENTION

Methods for clearing blur images of a monitor are provided. An exemplary embodiment of a method for clearing blur images of a monitor comprises the following. An original image data is providing. The original image data is transformed from an RGB encoded format to a YUV encoded format. The transformation is compressed as the original image data with the YUV encoded format. The compressed original image data is written in a random access memory (RAM) using a predefined method. The compressed original image data is decompressed. The original image data is transformed from the YUV encoded format to the RGB encoded format. The original image data is outputted to a display device using a driving unit.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein:

FIG. 1 is a schematic view of a device for clearing blur images of a monitor of the present invention.

DETAILED DESCRIPTION OF THE INVENTION

Several exemplary embodiments of the invention are described with reference to FIG. 1, which generally relate to clearing blur images of a monitor. It is to be understood that the following disclosure provides various different embodiments as examples for implementing different features of the invention. Specific examples of components and arrangements are described in the following to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various described embodiments and/or configurations.

The invention discloses a method for clearing blur images of a monitor.

FIG. 1 is a schematic view of a device for clearing blur images of a monitor of the present invention.

As shown in FIG. 1, the device for clearing blur images of a monitor 1 comprises an RGB-to-YUV transformation unit 11, a compression unit 12, a RAM 13, a decompression unit 14, a YUV-to-RGB transformation unit 15, a speed-up driving and processing unit 16, and a multiplexer 17.

The device for clearing blur images of a monitor 1 first retrieves original image data 111 divided into even serial data and odd serial data. The original image data 111 is input in the RGB-to-YUV transformation unit 11 to be transformed to YUV image data. The transformed original image data 111 is compressed using the compression unit 12. The compressed original image data 111 is stored in the RAM 13 using a predefined method and is accessed from the RAM 13 to be decompressed using the decompression unit 14. The decompressed original image data 111 is transformed to RGB image data using the YUV-to-RGB transformation unit 15. The transformed original image data 111 is quickly output to the multiplexer 17 by using the speed-up driving and processing unit 16, and is output to a display device (not shown) via the multiplexer 17.

The RAM may be an SRAM. To accelerate writing of image data in the SDRAM and accessing the image data from the SRAM, different processes are respectively implemented to even serial data and odd serial data of the image data.

With respect to the processes related to the odd serial data of the image data:

1. Input pixel data (with the RGB encoded format, numbered by NF_PL_RGB) is stored in the first temporary storage serial of the SRAM;

2. Compressed data (numbered by PF_COMP) is accessed from the SDRAM and stored in the second temporary storage serial of the SRAM; and 3. Data stored in the third temporary storage serial of the SRAM is accessed and output.

With respect to the processes related to the even serial data of the image data:

1. Input pixel data (with the RGB encoded format, numbered by NF_PL_RGB) stored in the first temporary storage serial of the SRAM and input serial data (numbered by NF_NL_RGB) are accessed and transformed to the YUV encoded format;

2. The transformed data is compressed from 24-bit to 16-bit and the compressed data (numbered by NF_COMP) is stored in the SDRAM;

3. Data (numbered by PF_COMP) stored in the second temporary storage serial of the SRAM is accessed and compared with data (numbered by NF_COMP) transformed as the compressed YUV encoded format;

4. The PF_COMP data is decompressed and transformed to the RGB encoded format to obtain the PF_PL_RGB data and the PF_NL_RGB data;

5. The PF_PL_RGB data and the NF_PL_RGB data are compared using a lookup table to obtain a speed-up driving and processing value of PL (OVER_PL) while the PF_NL_RGB data and the NF_NL_RGB data are compared using the lookup table to obtain a speed-up driving and processing value of NL (OVER_NL);

6. The PF_COMP is subtract from the NF_PL_RGB to obtain a value J; and

7. If J is greater than a predetermined value, the OVER_PL is output and the OVER_NL is stored in the third temporary storage serial of the SRAM, and if J is less than a predetermined value, the NF_PL_RGB data is output and the NF_NL_RGB data is stored in the third temporary storage serial of the SRAM.

As described, a transformation equation for transforming the RGB encoded format to the YUV encoded format is represented as follows:

$Y=0.299R+0.587G+0.114B$;

$U=(-0.172)R+(-0.339)G+0.511B+128$; and $V=0.511R+(-.0.428)G+(-0.083)B+128$.

A transformation equation for transforming the YUV encoded format to the RGB encoded format is represented as follows:

$R=Y+1.371V$;

$G=Y+(*0.336)(U-128)+(-0.0698)(V-128)$; and $B=Y+1.732U$.

Due to the storage operations for the SDRAM, the device for clearing blur images of a monitor 1 can rapidly process image information and display the image information on an LCD screen using the speed-up driving and processing unit 16, effectively clearing blur images of the LCD screen.

Methods and systems of the present disclosure, or celtain aspects or portions of embodiments thereof, may take the form of a program code (i.e., instructions) embodied in media, such as floppy diskettes, CD-ROMS, hard drives, firmware, or any other machine-readable storage medium, wherein, when the program code is loaded into and executed by a machine, such as a computer, the machine becomes an apparatus for practicing embodiments of the disclosure. The methods and apparatus of the present disclosure may also be embodied in the form of a program code transmitted over some transmission medium, such as electrical wiring or cabling, through fiber optics, or via any other form of transmission, wherein, when the program code is received and loaded into and executed by a machine, such as a computer, the machine becomes an apparatus for practicing and embodiment of the disclosure. When implemented on a general-purpose processor, the program code combines with the processor to provide a unique apparatus that operates analogously to specific logic circuits.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for clearing blur images of a monitor, applied for blur image occurrence due to dynamic display delay of an LCD screen, comprising:

providing original image data which is divided into odd serial data and even serial data;

storing the original image data in a first temporary storage serial of a first memory device in a process of the odd serial data;

accessing a first compressed original image data stored in a second memory device and storing the first compressed original image data into a second temporary storage serial of the first memory device in the process of the odd serial data;

accessing data stored in a third temporary storage serial of the first memory device in the process of the odd serial data;

outputting the data stored in the third temporary storage serial of the first memory device to a display device through a driving unit in the process of the odd serial data;

accessing the original image data stored in the first temporary storage serial of the first memory device and input serial data in a process of the even serial data;

transforming the original image data and the input serial data to a YUV encoded format in the process of the even serial data;

compressing the transformed original image data from 24-bit to 16-bit into a second compressed original image data in the process of the even serial data;

storing the second compressed original image data in the second memory device in the process of the even serial data;

accessing the first compressed original image data stored in the second temporary storage serial of the first memory device in the process of the even serial data;

comparing the first compressed original image data and the second compressed original image data in the process of the even serial data;

decompressing the first compressed original image data and transforming the first compressed original image data to a RGB encoded format to obtain a first data and a second data in the process of the even serial data;

comparing the first data with the original image data to obtain a first speed-up driving and processing value in the process of the even serial data;

comparing the second data with the input serial data to obtain a second speed-up driving and processing value in the process of the even serial data;

comparing the first compressed original image data with the second compressed original image data to determine whether outputting the first speed-up driving and processing value, or outputting the original image data, to the display device through the driving unit.

2. The method for clearing blur images of a monitor as claimed in claim 1, wherein outputting the first speed-up driving and processing value, the method further includes the step of storing the second speed-up driving and processing value into the third temporary storage serial of the first memory device in the process of the even serial data.

3. The method for clearing blur images of a monitor as claimed in claim 1, wherein outputting the original image data, the method further includes the step of storing the input serial data into the third temporary storage serial of the first memory device in the process of the even serial data.

* * * * *